US007661963B1

(12) United States Patent
Ju

(10) Patent No.: US 7,661,963 B1
(45) Date of Patent: Feb. 16, 2010

(54) SOCKET CONNECTOR

(75) Inventor: Ted Ju, Keelung (TW)

(73) Assignee: Lotes Co., Ltd, Keelung (TW)

( * ) Notice: Subject to any disclaimer, the term of this patent is extended or adjusted under 35 U.S.C. 154(b) by 0 days.

(21) Appl. No.: 12/354,805

(22) Filed: Jan. 16, 2009

(30) Foreign Application Priority Data

Oct. 28, 2008 (CN) ..... 2008 2 0202490 U

(51) Int. Cl.
*H01R 12/00* (2006.01)

(52) U.S. Cl. ..... 439/70

(58) Field of Classification Search ..... 439/70–73, 439/525, 526
See application file for complete search history.

(56) References Cited

U.S. PATENT DOCUMENTS 5,982,635 A * 11/1999 Menzies et al. ..... 361/790
6,659,795 B1 * 12/2003 Lai et al. ..... 439/526
6,896,525 B2 * 5/2005 Kuo ..... 439/72
7,170,165 B2 * 1/2007 Berto et al. ..... 257/718
2003/0157817 A1 * 8/2003 Chiu ..... 439/70
2007/0238327 A1 * 10/2007 Hsu ..... 439/70
2008/0009152 A1 * 1/2008 Colbert et al. ..... 439/73
2009/0111293 A1 * 4/2009 Rubenstein et al. ..... 439/73

* cited by examiner

*Primary Examiner*—Gary F. Paumen
(74) *Attorney, Agent, or Firm*—Ming Chow; Sinorica, LLC

(57) ABSTRACT

A socket connector is revealed. The socket connector is electrically connected with a chip module onto a circuit board. The chip module includes a carrier board, at least one chip electrically connected to one side of the carrier board and a heat spreader arranged on another side of chip and placed opposite to the side of chip connected with the carrier board. The carrier board disposed with a plurality of contact members includes a base arranged with a plurality of receiving slots and part of the contact members being in the receiving slot, a plurality of conductive terminals arranged in the receiving slots and contact with the contact members, and a cover that has one side connected with the base and the opposite side connected with the chip module while the cover is disposed with a plurality of receiving holes corresponding to the receiving slots for being inserted by the contact members. At least one projecting seat is arranged on the cover, against the chip module for supporting the chip. The receiving holes penetrate the projecting seat. The socket connector not only has better thermal performance of the chip but also favors distribution of circuit board wiring.

21 Claims, 9 Drawing Sheets

SOCKET CONNECTOR

BACKGROUND OF THE INVENTION

The present invention relates to a socket connector, especially to a socket connector that favors distribution of circuit board wiring.

Due to progress of the society and increasing requirements of live standard, electronics have become essentials of people's lives. Now due to highly competitiveness of electronic industry, more and more manufacturers are dedicated to invent electronics with compact volume, light weight and excellent performance so as to increase market share. Here raise a problem—there is a dilemma that the electronics need to satisfy both requirements-compact volume and good cooling effect.

Refer to FIG. 1, a common socket connector 1 used in industries is revealed. The common socket connector 1 is electrically connected with a chip module 2 on a circuit board (not shown in figure). The common socket connector 1 includes a base 10, a plurality of conductive terminals (not shown in figure) in the base 10 and a cover 11 that is arranged over the base 10. The chip module 2 disposed on the cover 11 consists of a carrier board 20 set over the cover 11, a chip 21 arranged on the carrier board 20 and a heat spreader 22 disposed on the chip 21. The chip 21 is covered over the carrier board 20 while the chip module 2 also includes a plurality of conductive pins (not shown in figure) arranged on surface of the carrier board 20.

Although a surface 110 on one side of the cover 11 that connects with the carrier board 20 is a flat surface with the same height, while assembling the chip module 2 on the surface 110 of the cover 11, the carrier board 20 may still contact with the surface 110 of the cover 11 on multiple points, not surface contact due to wrong position of the chip module 2 or concave/convex areas on the surface of the carrier board 20. Thus the loading points of the carrier board 20 are uncertain and are not close together. Therefore, the chip 21 is not always keeping good contact with the heat spreader 22 and the heat conduction between the chip 21 and the heat spreader 22 is not good. This has negative effects on heat transfer of the chip 21 and may lead to damages thereof after being used for a long time.

As shown in FIG. 2, an improved socket connector 3 used broadly in industries is disclosed. The socket connector 3 is electrically connected with a chip module 4 onto a circuit board (not shown in figure). The socket connector 3 is formed by a base 30, a plurality of conductive terminals (not shown in figure) in the base 30 and a cover 31 that is arranged over the base 30. The chip module 4 disposed on the cover 31 includes a carrier board 40 disposed over the cover 31, a chip 41 arranged on the carrier board 40 and a heat spreader 42 set on the chip 41. The chip 41 is covered over the carrier board 40 while the chip module 4 also includes a plurality of conductive pins (not shown in figure) arranged on surface of the carrier board 40.

In order to improve thermal performance of the chip 41, a plurality of supportive projecting points 311 are disposed on a surface 310 of the chip module 4 connected with the cover 31 for supporting the carrier board 40 so as to make the loading points on the carrier board 40 get close to one another and the contact between the chip 41 and the heat spreader 42 become more closer. However, after being used for quite a long time, the carrier board 40 deforms due to loading points concentrated on the supportive projecting points 311 and thus the chip 41 and the heat spreader 42 are disconnected with each other. This also leads to poor conduction between the chip 41 and the heat spreader 42. Thus the thermal performance of the chip 41 is affected negatively. Therefore, the device is out of order after long term use.

Refer to FIG. 3, a socket connector (not shown in figure) formed by improving of the above socket connector 3 used widely in industries is revealed. The socket connector is electrically connected with a chip module (not shown in figure) onto a circuit board (not shown in figure). The socket connector (not shown in figure) includes a base (not shown in figure), a plurality of conductive terminals (not shown in figure) in the base and a cover 50 that is arranged over the base (not shown in figure). The chip module (not shown in figure) disposed on the cover 50 includes a carrier board (not shown in figure) disposed over the cover 50, a chip (not shown in figure) arranged on the carrier board (not shown in figure) and a thermal spreader (not shown in figure) set on the chip (not shown in figure). The chip (not shown in figure) is covered over the carrier board (not shown in figure).

In order to make the chip (not shown in figure) have better cooling effect, a plurality of supportive projecting points 501 is disposed on a surface 500 of the cover 50 connected with the chip module (not shown in figure) for supporting the carrier board (not shown in figure). At the same time, a projecting seat 502 is arranged for supporting the carrier board (not shown in figure). Insertion holes 503 on the cover are arranged surrounding the projecting seat 502 for receiving conductive pins (not shown in figure) of the chip module (not shown in figure).

Under the condition that the number of conductive pins of the chip module in this device, the number of the conductive pins (not shown in figure) of the chip module 2 of the socket connector 1, and the number of the conductive pins (not shown in figure) of the chip module 4 of the socket connector 3 are all the same, the cover 50 should be with larger area than the area of the cover 11 and the area of the cover 31 for disposition of the insertion holes 503 with the same number of the conductive pins (not shown in figure) due to the projecting seat 502. Thus this has negative effects on distribution of circuit board wiring.

Thus there is a need to develop a new socket connector that overcomes above shortcomings.

SUMMARY OF THE INVENTION

Therefore it is a primary object of the present invention that favors distribution of circuit board wiring.

In order to achieve the object, a socket connector of the present invention is electrically connected with a chip module onto a circuit board. The chip module includes a carrier board. At least one chip is electrically connected to one side of the carrier board and a heat spreader arranged on another side of chip and placed opposite to the side of chip connected with the carrier board. A plurality of contact members is disposed on the carrier board. The socket connector consists of a base with a plurality of receiving slots, a plurality of conductive terminals, and a cover. Part of the contact members is in the receiving slot and the conductive terminals are mounted in the receiving slots, contacting with the contact members. One side of the cover connects with the base while the other side, opposite to the site with the base, connects with the chip module. A plurality of receiving holes corresponding to the receiving slots is arranged on the cover for being inserted by the contact members. A projecting seat is arranged on the cover, leaning against the chip module for supporting the chip while the receiving holes penetrate the projecting seat.

Compared with the technique available now, by means of the projecting seat on the cover and the plurality of receiving holes penetrating though the projecting seat and the cover, the projecting seat leans against the carrier board so as to make the chip on the carrier board keep good contact with the heat spreader. Thus the chip is ensured to have good cooling effect. Moreover, there is no need to increase area of the cover for disposition of the receiving holes and this favors distribution of circuit board wiring.

A socket connector of the present invention of the present invention is electrically connected with a chip module onto a circuit board. The chip module includes a carrier board. At least one chip is electrically connected to one side of the carrier board and a heat spreader arranged on another side of chip and placed opposite to the side of chip connected with the carrier board A plurality of contact members is disposed on the carrier board. The socket connector includes a base with a plurality of receiving slots, a plurality of conductive terminals mounted in the receiving slots for contacting with the contact members, and a cover. Part of the contact members is in the receiving slot. One side of the cover connects with the base while the other side opposite to the side connected with the base connects to the chip module. The cover is disposed with at least one projecting seat that leans against the chip module for supporting the chip. The plurality of receiving holes penetrates the cover and the projecting seat, corresponding to the receiving slots and being inserted by the contact members. The vertical projection of the chip of the chip module covers the projecting seat on the cover.

Compared with the prior art, by means of at least one projecting seat disposed on the cover, the plurality of receiving holes penetrating though the projecting seat and the cover, and the vertical projecting of the chip of the chip module covering the projecting seat on the cover, the projecting seat leans against the carrier board so as to make the chip on the carrier board keep good contact with the heat spreader. Thus the chip is ensured to have good cooling effect. Moreover, there is no need to increase area of the cover for disposition of the receiving holes and this favors distribution of circuit board wiring.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
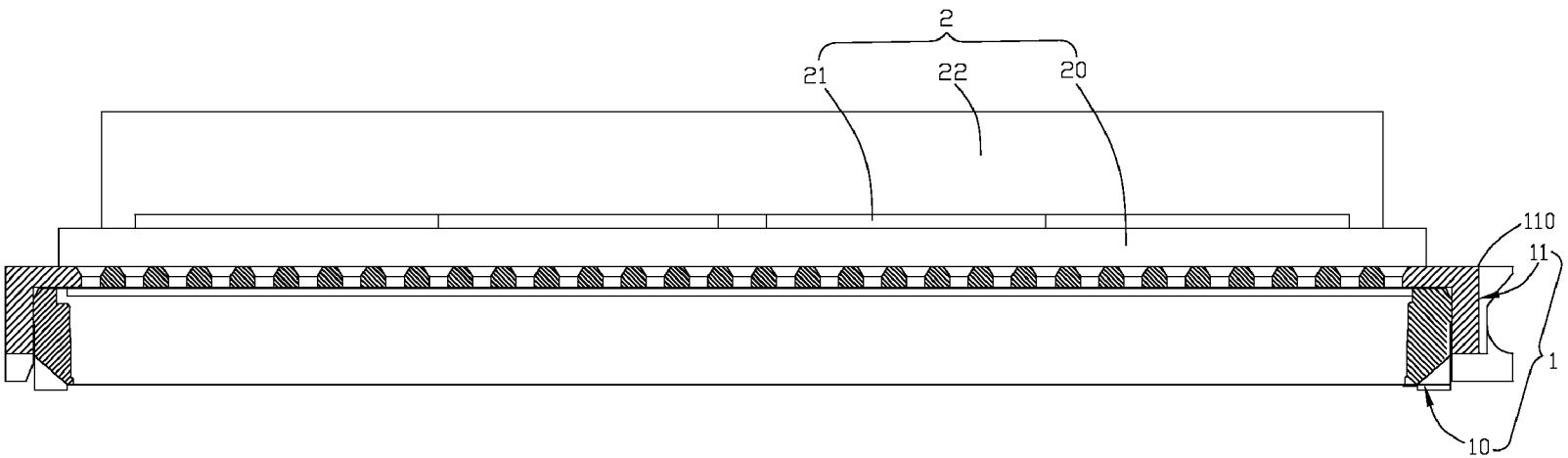
Fig.1 (Prior Art)
FIG. 1 is a schematic drawing showing a socket connector in prior art.
Figure 2:
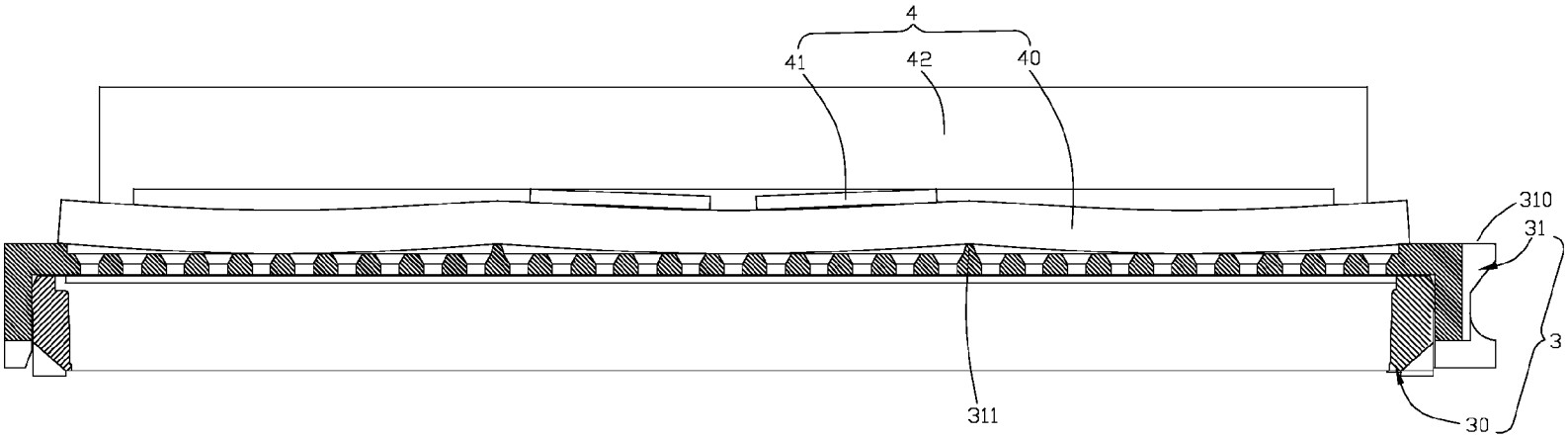
Fig.2 (Prior Art)
FIG. 2 is a schematic drawing showing another socket connector in prior art.
Figure 3:
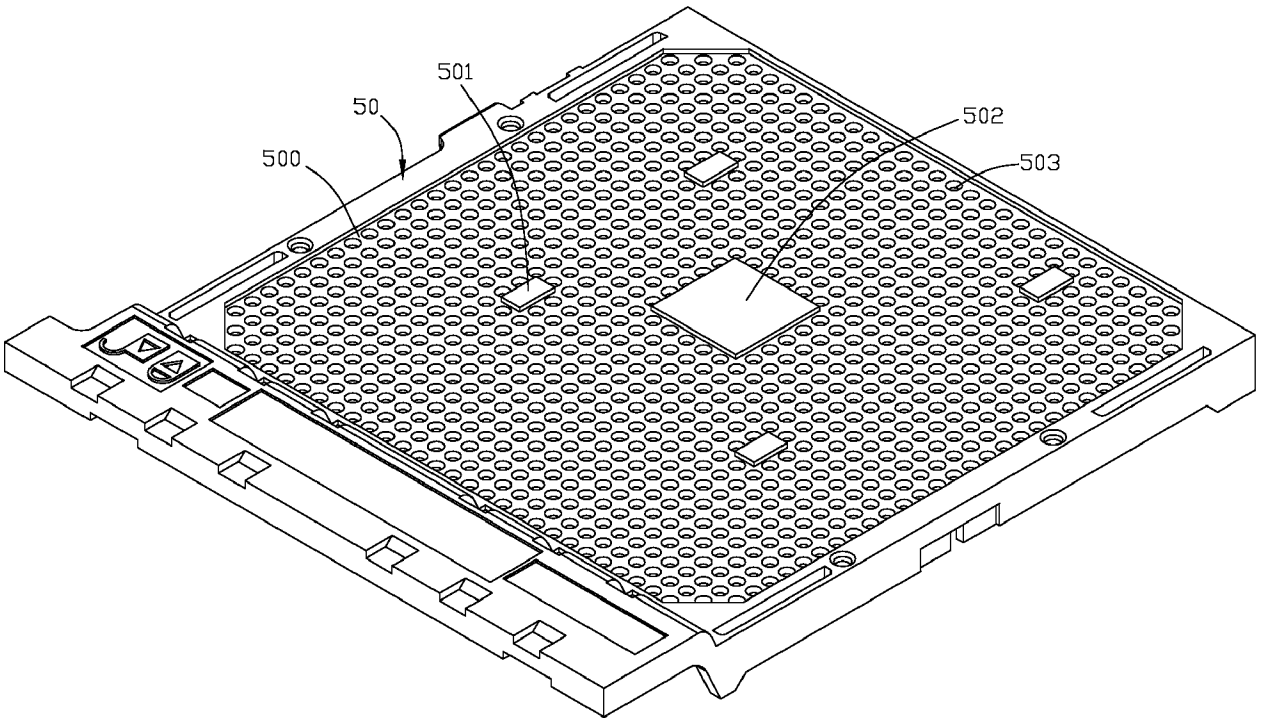
Fig.3 (Prior Art)
FIG. 3 is a schematic drawing showing a cover of a further socket connector in prior art.
Figure 4:
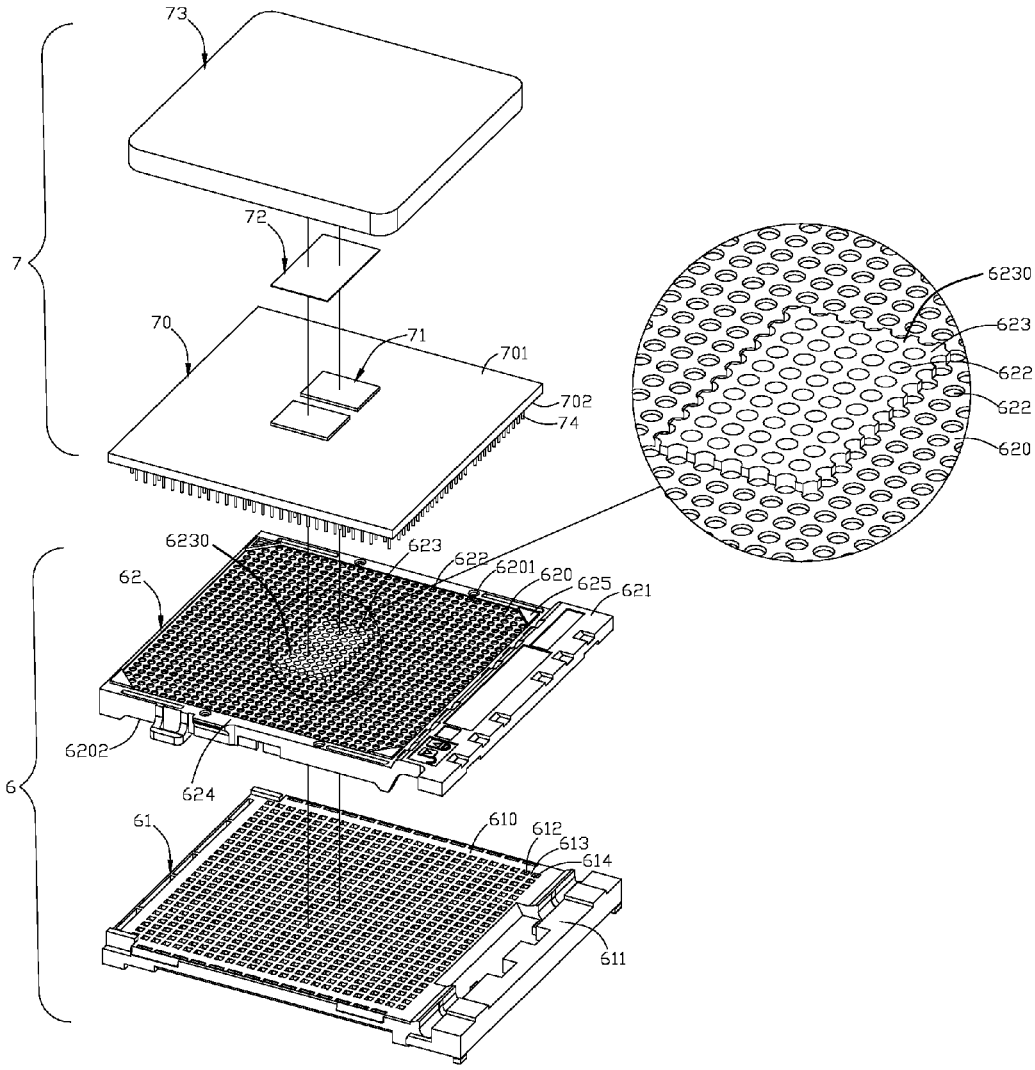
FIG. 4 is an explosive view of an embodiment of a socket connector according to the present invention.
Figure 5:
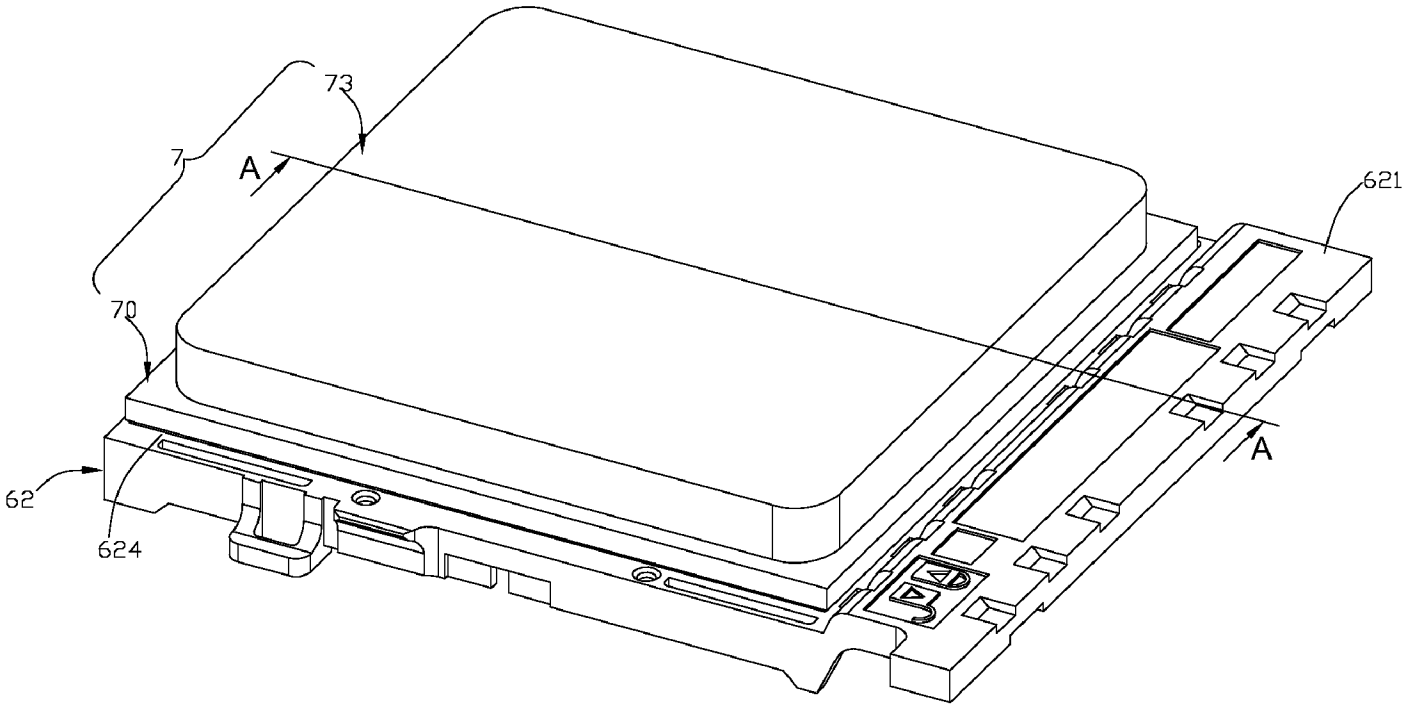
FIG. 5 is a schematic drawing showing assembling of a cover with a chip module of the above embodiment according to the present invention.
Figure 6:
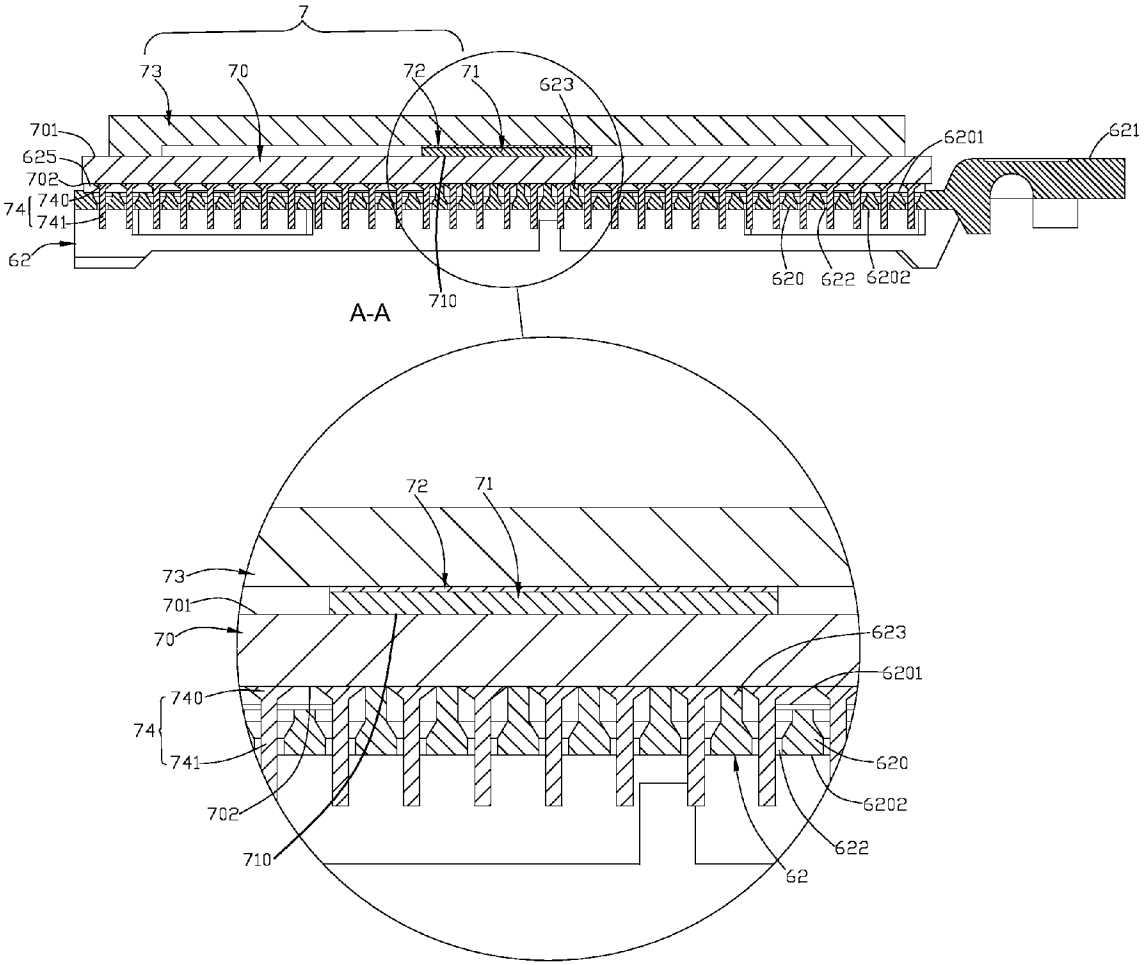
FIG. 6 is a cross sectional view along a A-A line of the embodiment in FIG. 5.

Refer from FIG. 4 to FIG. 6, an embodiment of a socket connector 6 according to the present invention is disclosed. The socket connector 6 is electrically connected with a chip module 7 onto a circuit board (not shown in figure). The chip module 7 in the socket connector 6 is a central processing unit (CPU) that can be a double-core CPU (CPU with two chips) or a single-core CPU (CPU with one chip).

The socket connector 6 includes a base 61, a plurality of conductive terminals (not shown in figure), a rocker (not shown in figure), and a cover 62. The conductive terminals (not shown in figure) are mounted in the base 61, the rocker (not shown in figure) is pivoted on one end of the base 61 and one side of the cover 62 connects with the base 61 while the side opposite to the side connected with the base 61 connects to the chip module 7.

Refer from FIG. 4 to FIG. 6, the base 61 includes a main body 610 for loading the cover 62 and an extension part 611 extending from one end of the main body 610.

A plurality of receiving slots 612 is disposed on the main body 610 of the base 61 while a plurality of crossed horizontal gaps 613 and vertical gaps 614 are arranged on the main body 610 for supporting the cover 62. Each set of crossed horizontal gap 613 and vertical gap 614 separate four receiving slots 612. In other embodiment, each set of the crossed horizontal gap 613 and the vertical gap 614 also separate at least four receiving slots 612.

The conductive terminals (not shown in figure) are mounted in the receiving slots 612.

The rocker (not shown in figure) is pivoted on the extension part 611.

Refer from FIG. 4 to FIG. 6, the cover 62 includes a loading part 620 for loading the chip module 7 and a projecting part 621 that is extended from one end of the loading part 620 and is connected to the extension part 611 of the base 61.

The loading part 620 consists of a top surface 6201 and a bottom surface 6202 opposite to the top surface. The chip module 7 is disposed on the top surface 6201 while the base 61 is arranged on the bottom surface 6202.

A plurality of receiving holes 622, inserting through the top surface 6201 and the bottom surface 6202 and corresponding to the receiving slot 612, is arranged on the loading part 620 of the cover 62. A projecting seat 623 that leans against the chip module 7 is disposed on the top surface 6201 of the loading part 620 of the cover 62. Part of the receiving holes 622 penetrates the projecting seat 623. That means the projecting seat 623 is disposed with the receiving holes 622. Thus there is no need to preset a space corresponding to the projecting seat 623 on the chip module 7 for accommodating the said projecting seat 623. The projecting seat 623 includes a top surface 6230.

Moreover, four side strips 624 with similar height and four projecting blocks 625 with similar height are disposed on the top surface 6201 of the loading part 620 of the cover 62. The four projecting blocks 625 are arranged on four corners of the loading part 620 for enclosing the receiving holes 622 and supporting the chip module 7. The four side strips 624 are around the four projecting blocks 625 and are taller than the top surface 6201 while the four projecting blocks 625 are taller than the four side strips 624. The height of the four projecting blocks 625 is similar to that of the projecting seat 623. Due to errors occurred while being manufactured, the height of the projecting blocks 625 and that of the projecting seat 623 may have a little difference or the same with each other.

Of course, in some other embodiments, the loading part 620 may not be arranged with the four projecting blocks 625 and with only four side strips 624 with similar height to around the receiving holes 622 and load the chip module 7. And the height of the four side strips 624 is about the same with that of the projecting seat 623.

Refer from FIG. 4 to FIG. 6, the chip module 7 disposed on the top surface 6201 of the cover 62 of the socket connector 6 consists of a carrier board 70, two chips 71 (in a single-core CPU, there is only one chip 71), a thermal grease 72 and a heat spreader 73. The two chips 71 are electrically connected on one side of the carrier board 70 and the heat spreader 73 is arranged on the same side of the carrier board 70 while the thermal grease 72 is set between the heat spreader 73 and the two chips 71.

The carrier board 70 includes a first surface 701 and a second surface 702, opposite to each other. The two chips 71 are disposed on the first surface 701, the cover 62 is located on the second surface 702, and the top surface 6230 of the projecting seat 623 corresponds to the second surface 702.

The two chips 71 have a bottom surface 710 that connects and corresponds to the first surface 701 of the carrier board 70.

A plurality of contact members 74 is arranged on the carrier board 70 of the chip module 7. Each contact member 74 includes a base part 740 projecting out of the second surface 702 of the carrier board 70 and electrically connected to the two chips 71, and a contacting part 741 extending from the base part 740.

The contacting part 741 inserts through the receiving hole 622 on the cover 62 and part thereof enters the receiving slot 612 of the base 61, contacting with the conductive terminal (not shown in figure) inside the receiving slot 612.

The thermal grease 72 can work as thermal conductive material so that heat from the two chips 71 is conducted to the heat spreader 73. After being dried, the thermal grease 72 prevents cracks generated between the two chips 71 and the heat spreader 73 and further avoids poor contact therebetween that may lead to poor conductivity of the heat from the two chips 71 to the heat spreader 73 for being dissipated.

While assembling, refer from FIG. 4 to FIG. 6, the conductive terminals (not shown in figure) are mounted in the receiving slot 612 of the base 61 firstly.

Then the rocker (not shown in figure) is pivoted on the extension part 611 of the base 61.

Next the cover 62 is arranged on the base 61 so that the loading part 620 of the cover 62 matches the main body 610 of the base 61 and each receiving hole 622 on the cover 62 corresponds to each receiving slot 612 on the base 61. Thus the projecting part 621 of the cover 62 corresponds to the extension part 611 of the base 61. And the horizontal gap 613 and the vertical gap 614 of the base 61 support the bottom surface 6202 of the cover 62 so as to increase strength of the cover 62. Therefore the assembling of the socket connector 6 is finished. Move the rocker (not shown in figure) forward and backward so that the rocker (not shown in figure) drives the covers 62 moving forward and backward on the base 61.

At last, the chip module 7 is assembled onto the socket connector 6 and the carrier board 70 of the chip module 7 locates over the loading part 620 of the cover 62 and the top surface 6230 of the projecting seat 623 corresponds to the second surface 702 of the carrier board 70. The contacting part 741 of the contact members 74 arranged on the second surface 702 of the carrier board 70 inserts through the receiving hole 622 on the cover 62 and part of the contacting part 741 enters the receiving slot 612 of the base 61, contacting with the conductive terminal (not shown in figure) mounted in the receiving slot 612.

Because part of the receiving holes 622 of the cover 62 penetrates the projecting seat 623, there is no need to preset a space on the carrier board 70 with the contact members 74 of the chip module 7 corresponding to the projecting seat 623 for avoiding the said projecting seat 623. That means the position on the carrier board 70 corresponding to the projecting seat 623 is disposed with the contact members 74. Thus there is no need to increase the area of the chip module 7 and the receiving holes 622 on the cover 62 are also not added. Furthermore, the area of the cover 62 also needs not to be increased and this favors distribution of circuit wiring on the circuit board (not shown in figure) and development of compact volume of the electronics-socket connectors 6.

Because the height of the four projecting blocks 625 is almost the same height with that of the projecting seat 623, the projecting seat 623 of the cover 62 together with the four projecting blocks 625, lean against the second surface 702 of the carrier board 70 (although there may be manufacturing error that leads to a bit difference between the height of the projecting blocks 625 and that of the projecting seat 623 or the same with each other, the four projecting blocks 625 still lean against the second surface 702 of the carrier board 70). Thus the carrier board 70 will not easily get deformed while contacting with the cover 62 in multiple points. Now vertical projection of the two chips 71 of the chip module 7 covers the projecting seat 623 of the cover 62 and the top surface 6230 of the projecting seat 623 corresponds to the bottom surface 710 of the two chips 71 vertically. That means the projecting seat 623 leans against the carrier board 70 on the position connected with the two chips 71 and provides the chip module 7 good support. Due to support from the projecting seat 623 against the second surface 702 of the carrier board 70, the strength of the cover 62 is increased. Moreover, the cover 62 also gets higher strength from support of the horizontal gaps 613 and vertical gaps 614 of the base 61. Thus the force of the projecting seat 623 against carrier board 70 is larger. Therefore, under leaning of the projecting seat 623, the two chips 71 on the carrier board 70 press the thermal grease 72 so as to make the thermal grease 72 attaches on the heat spreader 73 closely and the contact between the two chips 71 and the heat spreader 73 through the thermal grease 72 is getting better. This improves thermal performance of the two chips 71. Furthermore, the vertical projection of the two chips 71 of the chip module 7 may not cover the projecting seat 623 of the cover 62. Only under the condition that a certain area of the carrier board 70 that is connected with the two chips 71 is leaned, the two chips 71 have the same cooling effect.

In addition, the diameter of the receiving slot 612 of the base 61 can be reduced so that only the projecting seat 623 of the cover 62 leans against the base part 740 of the contact member 74 while the position of the projecting seat 623 against the base part 740 is just corresponding to the position of the two chips 71. Thus the force passing through the base part 740 is transferred to the carrier board 70 and then to the two chips 71 so that the two chips 71 press the thermal grease 72. Therefore, the two chips 71 through the thermal grease 72 keep better contact with the heat spreader 73 and this is good for heat removal of the two chips 71.

In other embodiment, the height of the four projecting blocks 625 may be higher or lower than that of the projecting seat 623 and the following conditions occur:

when the height of the four projecting blocks 625 is lower than that of the projecting seat 623, only the projecting seat 623 leans against the second surface 702 of the carrier board 70. Now the force acted on the carrier board 70 is concentrated on the position that the projecting seat 623 leans against. And the vertical projection of the two chips 71 of the chip module 7 covers the projecting seat 623 of the cover 62 and the top surface 6230 of the projecting seat 623 corresponds to the bottom surface 710 of the two chips 71 so as to provide the chip module 7 good support and make the two chips 71 on the carrier board 70 press the thermal grease 72. Thus the two chips 71 has better contact with the heat spreader 73 through the thermal grease 72. Therefore, the heat removal of the two chips 71 is improved.

Moreover, the diameter of the receiving slot 612 of the base 61 is decreased so that only the projecting seat 623 leans against the base part 740 of the contact member 74. Thus also helps the two chips 71 keeping better contact with the heat spreader 73 through the thermal grease 72 and further improve cooling effect of the two chips 71.

When the height of the four projecting blocks 625 is higher than that of the projecting seat 623, the four projecting blocks 625 lean against the second surface 702 of the carrier board 70. And the vertical projection of the two chips 71 of the chip module 7 covers the projecting seat 623 of the cover 62 and the top surface 6230 of the projecting seat 623 corresponds to the bottom surface 710 of the two chips 71. Now the diameter of the of the receiving slot 612 of the base 61 is reduced so as to make the projecting seat 623 of the cover 62 lean against the base part 740 of the contact member 74. Thus the two chips 71 on the carrier board 70 press the thermal grease 72 so that the two chips 71 keep good contact with the heat spreader 73 through the thermal grease 72. Therefore, heat transfer of the two chips 71 is improved.

In other embodiments, when the loading part 620 is only disposed with four side strips 624 with similar height and the projecting seat 623 also with similar height of the four side strips 624, once the height of the side strips 624 is similar to that of the projecting seat 623, the four side strips 624 together with the projecting seat 623 lean against the second surface 702 of the carrier board 70. Moreover, the diameter of the receiving slot 612 of the base 61 can be reduced so that on the cover 62, only the projecting seat 623 leans against the base part 740 of the contact member 74. If the height of the four side strips 624 is a bit lower than that of the projecting seat 623, only the projecting seat 623 leans against the second surface 702 of the carrier board 70. Furthermore, the diameter of the receiving slot 612 of the base 61 can be reduced so that on the cover 62, only the projecting seat 623 leans against the base part 740 of the contact member 74. If the height of the four side strips 624 is a bit higher than that of the projecting seat 623, the four side strips 624 lean against the second surface 702 of the carrier board 70. Now the diameter of the receiving slot 612 of the base 61 is reduced so that the projecting seat 623 can lean against the base part 740. Thus the two chips 71 on the carrier board 70 press the thermal grease 72 to make the two chips 71 keep good contact with the heat spreader 73 through the thermal grease 72. Therefore heat transfer of the two chips is enhanced.

Figure 7:
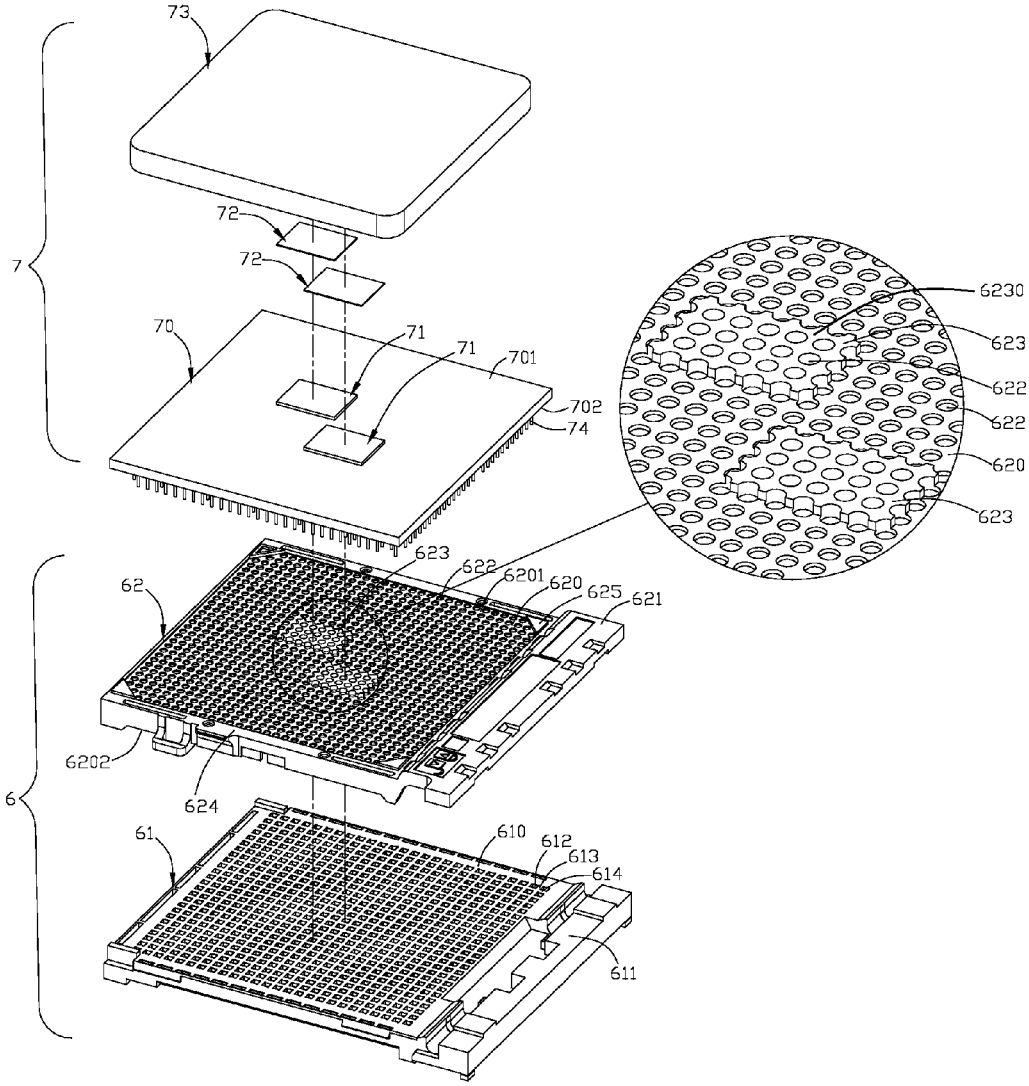
FIG. 7 is an explosive view of another embodiment of a socket connector according to the present invention.
Figure 8:
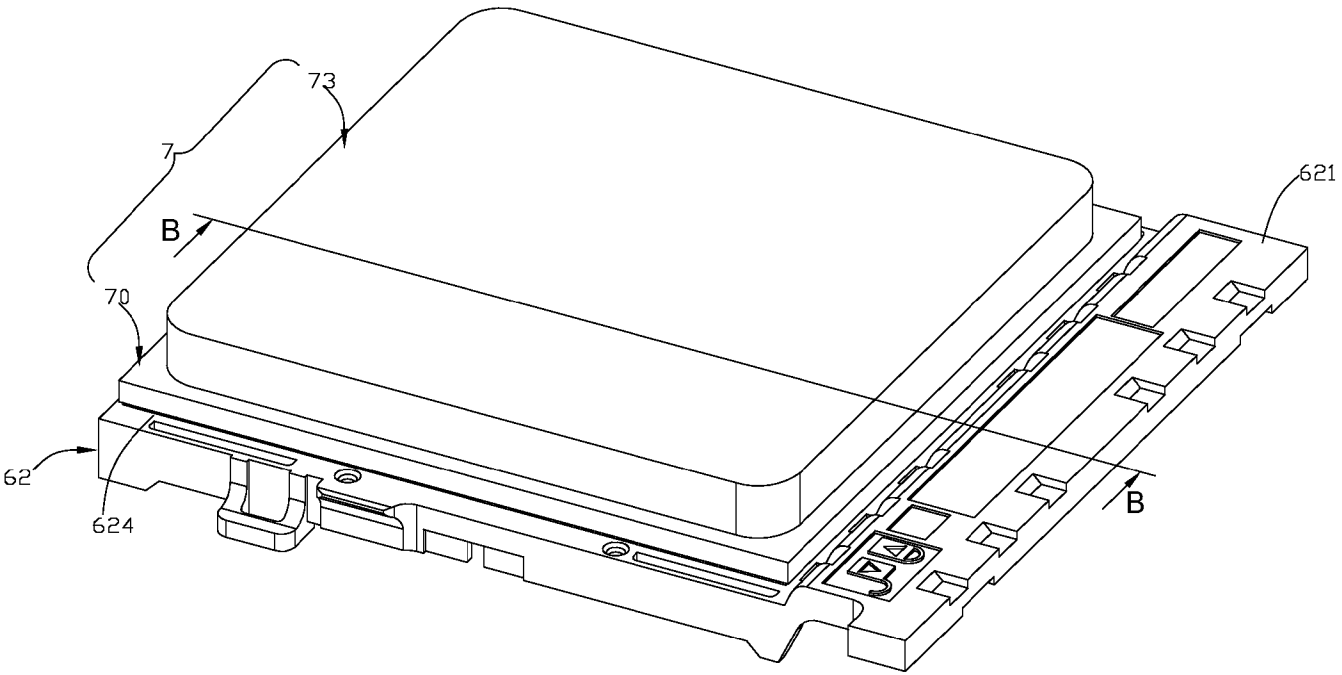
FIG. 8 is a schematic drawing showing assembling of a cover with a chip module of the above embodiment according to the present invention.
Figure 9:
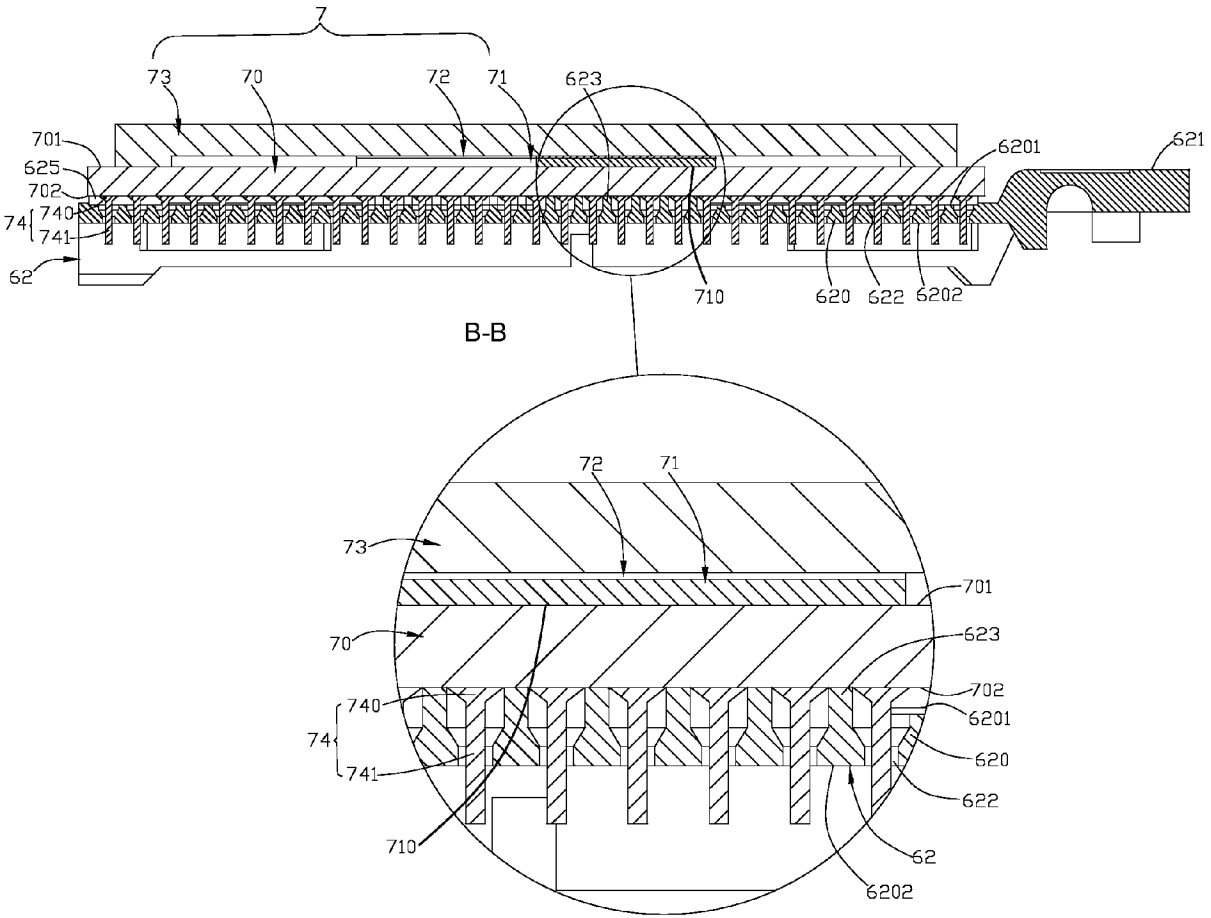
FIG. 9 is a cross sectional view along a B-B line of the embodiment in FIG. 8.

Refer from FIG. 7 to FIG. 9, this is another embodiment of the socket connector 6 of the present invention. The difference between this embodiment and the above one is only in that: the cover 62 is disposed with two projecting seats 623 so that the strength of the cover 62 is further increased. The positions of the two projecting seats 623 are staggered and so are the positions of the two chips 71 on the chip module 7 while the projecting seats 623 and the chips 71 are corresponding to each other. The positions of the thermal grease 72 arranged on the chip module 7 are also staggered and are corresponding to the staggered chips 71. Such design also favors distribution of circuit board wiring as well as cooling effect of the two chips 71, the same as the above embodiment.

In other embodiments, the cover 62 can be arranged with at least two projecting seats 623 so as to increase strength of the cover 62 and lean against the two chips 71 of the chip module 7 so as to make the two chips 71 keep good contact with the heat spreader 73 for improving cooling effects of the two chips 71.

In summary, the socket connector according to the present invention has following advantages:

compared with techniques available now, through at least one projecting seat disposed on the cover and part of the receiving holes penetrating the projecting seat, there is no need arrange a space on the carrier board of the chip module with contact members, corresponding to the projecting seat for accommodating the said projecting seat. That means the area on the carrier board corresponding to the projecting seat can be disposed with contact members so that there is no need to increase the area of the chip module. Thus the number of the receiving holes disposed on the cover also needs not to be increased and the area of the cover will not increase. This favors wiring distribution on the circuit board (not shown in figure) and is beneficial to development of compact volume of socket connectors.

At the same time, through the projecting seat against the carrier board on the position with the chips, the chips on the carrier board press the thermal grease under the action of the force from the projecting seat so that the thermal grease attaches the heat spreader more closely. Thus the chips have better contact with the heat spreader through the thermal grease and this improves cooling effect of the chips.

Moreover, through the thermal grease disposed between the chips and the heat spreader, there is no crack generated between the chips and the heat spreader so as to avoid poor contact between the chips and the heat spreader that may lead poor heat transfer from the chips to the heat spreader is prevented.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A socket connector electrically connected with a chip module that includes a carrier board having a plurality of contact members, at least one chip electrically connected to one side of the carrier board, and a heat spreader arranged on another side of the chip and placed opposite to the side of the chip connected with the carrier board onto a circuit board, comprising:

a base arranged with a plurality of receiving slots and part of the contact members being in the receiving slots, a plurality of conductive terminals arranged in the receiving slots and making contact with the contact members, and a cover that has one side connected to the base and an opposite side connected to the chip module; wherein the cover has a plurality of receiving holes corresponding to the receiving slots for receiving the contact members; the cover is disposed with at least one projecting seat resting against the chip module for supporting the chip and the receiving holes penetrating the projecting seat.

2. The socket connector as claimed in claim 1, wherein the projecting seat rests against the carrier board.

3. The socket connector as claimed in claim 1, wherein each contact member includes a base part projecting out of one side of the carrier board and electrically connected to the chip, and a contacting part extending from the base part while the projecting seat resists against the base part.

4. The socket connector as claimed in claim 1, wherein the cover has a loading part for loading the chip module and a projecting part that extends from one end of the loading part and is connected to the base; the loading part engages the projecting seat while both the loading part and the projecting seat engage the receiving holes.

5. The socket connector as claimed in claim 4, wherein the loading part has four side strips that are loaded with the chip module and encloses the receiving holes while the height of the four side strips is about the same as the height of the projecting seat.

6. The socket connector as claimed in claim 4, wherein the loading part has four side strips that are loaded with the chip module and encloses the receiving holes while the height of the projecting seat is higher than the height of the four side strips.

7. The socket connector as claimed in claim 4, wherein the loading part has four projecting blocks that are loaded with the chip module and is enclosing the receiving holes while the height of the projecting block is about the same as the height of the projecting seat.

8. The socket connector as claimed in claim 4, wherein the loading part has four projecting blocks that are loaded with the chip module and encloses the receiving holes while the height of the projecting seat is higher than the height of the projecting blocks.

9. The socket connector as claimed in claim 1, wherein the base has a plurality of crossed horizontal gaps and vertical gaps, the crossed horizontal gaps and vertical gaps separating at least four receiving slots.

10. The socket connector as claimed in claim 1, wherein the cover has two projecting seats.

11. The socket connector as claimed in claim 1, wherein the projecting seat includes a top surface and the chip includes a bottom surface while the top surface of the projecting seat vertically corresponds to the bottom surface of the chip.

12. A socket connector electrically connected with a chip module that includes a carrier board disposed with a plurality of contact members, at least one chip electrically connected to one side of the carrier board, and a heat spreader arranged on another side of the chip and placed opposite to the side of the chip connected with the carrier board onto a circuit board comprising:

a base arranged with a plurality of receiving slots and part of the contact members being in the receiving slots, a plurality of conductive terminals arranged in the receiving slots and contacting with the contact members, and a cover that has one side connected with the base and the opposite side connected with the chip module, wherein the cover has at least one projecting seat resting against the chip module for supporting the chip and a plurality of receiving holes penetrating the cover as well as the projecting seat and corresponding to the receiving slots for receiving the contact members; vertical projection of the chip of the chip module covers the projecting seat of the cover.

13. The socket connector as claimed in claim 12, wherein the projection seat rests against the carrier board.

14. The socket connector as claimed in claim 12, wherein the contact member comprising a base part projecting out of one side of the carrier board and electrically connected to the chips, and a contacting part extending from the base part while the projecting seat rests against the base part.

15. The socket connector as claimed in claim 12, wherein the cover has a loading part for loading the chip module and a projecting part that extends from one end of the loading part and is connected to the base; the loading part engages the projecting seat while both the loading part and the projecting seat engage the receiving holes.

16. The socket connector as claimed in claim 15, wherein the loading part has four side strips that are loaded with the chip module and encloses the receiving holes while the height of the four side strips is about the same as the height of the projecting seat.

17. The socket connector as claimed in claim 15, wherein the loading part has four side strips that are loaded with the chip module and encloses the receiving holes while the height of the projecting seat is higher than the height of the four side strips.

18. The socket connector as claimed in claim 15, wherein the loading part has four projecting blocks that are loaded with the chip module and encloses the receiving holes while the height of the projecting block is about the same as the height of the projecting seat.

19. The socket connector as claimed in claim 15, wherein the loading part has four projecting blocks that are loaded with the chip module and encloses the receiving holes while the height of the projecting seat is higher than the height of the projecting blocks.

20. The socket connector as claimed in claim 12, wherein the base has a plurality of crossed horizontal gaps and vertical gaps, the crossed horizontal gaps and vertical gaps separating at least four receiving slots.

21. The socket connector as claimed in claim 12, wherein the cover has two projecting seats.

* * * * *